United States Patent [19]

Hearst et al.

[11] Patent Number: 4,827,643

[45] Date of Patent: May 9, 1989

[54] IDENTIFICATION DEVICE FOR A CONTAINER

[75] Inventors: David T. Hearst, Chardon, Ohio; Walter M. Schneider, Thornton, Ill.

[73] Assignee: AGA Gas Central, Inc., Cleveland, Ohio

[21] Appl. No.: 805,846

[22] Filed: Dec. 5, 1985

Related U.S. Application Data

[63] Continuation-in-part of Ser. No. 688,073, Dec. 31, 1984, abandoned.

[51] Int. Cl.[4] ..... G09F 13/12

[52] U.S. Cl. ..... 40/306; 40/642; 206/509; 220/5 R

[58] Field of Search ..... 40/10 R, 310, 312, 306, 40/307; 206/509

[56] References Cited

U.S. PATENT DOCUMENTS

| | | | |
|---|---|---|---|
| D. 287,265 | 12/1968 | Edwards | D23/2 |
| 2,449,181 | 9/1948 | Smiley | 40/19 |
| 2,613,462 | 10/1952 | Johnson | 40/307 |
| 2,703,546 | 3/1955 | Allen | 40/306 |
| 2,930,155 | 3/1960 | Becker | 40/2 |
| 3,079,716 | 3/1963 | Ruiji | 40/307 |
| 3,211,470 | 10/1965 | Wilson | 283/18 |
| 3,256,978 | 6/1966 | Srigley et al. | 206/47 |
| 3,494,059 | 2/1970 | Minasian | 40/306 |
| 3,702,511 | 11/1972 | Miller | 40/306 |
| 3,787,993 | 1/1974 | Lyon | 40/306 |
| 3,952,438 | 4/1976 | Propst et al. | 40/300 |
| 4,282,974 | 8/1981 | Quandel | 40/397 |
| 4,537,150 | 8/1985 | Bowers | 119/14.17 |
| 4,541,402 | 9/1985 | Winters | 127/27 |
| 4,640,031 | 2/1987 | Hoeck et al. | 40/306 |

FOREIGN PATENT DOCUMENTS 260743 3/1968 Austria .

*Primary Examiner*—Gene Mancene
*Assistant Examiner*—Wenceslao J. Contreras
*Attorney, Agent, or Firm*—David A. Burge

[57] ABSTRACT

An identification device for a necked container includes a ring-like base structure that is installed about a container neck, and indicia that is carried by the base structure for presenting container data. Preferably the indicia includes presentations of container data that are manually and machine readable. Preferably the indicia is protected from harm by a transparent cover. In one embodiment the identification device has inwardly extending fingers to establish a secure mounting about the neck of the container on which it is mounted. In another embodiment, locking pins are used to establish a secure mounting.

13 Claims, 4 Drawing Sheets

IDENTIFICATION DEVICE FOR A CONTAINER

CROSS-REFERENCE TO RELATED APPLICATIONS

The present application is a continuation-in-part of application Ser. No. 688,073 filed Dec. 31, 1984, entitled IDENTIFICATION DEVICE FOR A CONTAINER, which was abandoned in favor of the present application.

Reference also is made to a companion Design application, Ser. No. 805,841 filed Dec. 5, 1987, entitled IDENTIFICATION DEVICE FOR A CONTAINER.

BACKGROUND OF THE INVENTION

1. Field of the Invention

The present invention relates generally to an identification device for a necked container, and more particularly, to a fixed identification collar that is attachable to the neck of a container and that has information encoded thereon which can be read either manually or automatically.

2. Prior Art

A wide variety of industries employ reusable containers for transporting and dispensing consumable products. These containers generally are expensive and are subjected to a wide variety of environmental conditions during transportation and use. A container of particular interest is that used to store pressurized gas such as oxygen, nitrogen and the like. Such containers commonly are referred to as "cylinders" or "gas cylinders," and those terms will be used hereafter to describe one particular type of container for which the invention has applicability.

In many applications it is necessary to be able to identify each individual cylinder by its serial number or other identifying information such as cylinder type, weight or contents. For convenience, such identifying information will be referred to hereafter as "cylinder data." The identification of cylinder data is a particular problem in the industrial gas industry wherein it is desirable to have cylinder data affixed to each cylinder in an encoded form to facilitate automatic reading of the cylinder data for input to a computerized inventory control system.

One method previously proposed for identifying pressurized gas containers has been to paint or stencil the cylinder data on the body or neck portion of the cylinder. A problem with this method resides in the impermanent nature of the painted or stenciled numbers or other identification markings. Because large numbers of cylinders are frequently transported on open trucks, they are often subjected to abrasive environmental conditions which tend to wear or degrade the quality of the markings. Also during loading and unloading operations, the cylinders are sometimes handled relatively roughly which tends to degrade, chip or smear the cylinder identification markings. As the markings become less legible, the chances for incorrect identification or a total loss of identification increase. In addition, this method of identifying cylinders is not well suited for automatic reading of cylinder data.

Another method of affixing information to the cylinders consists of inscribing the information on the walls or neck of the cylinder itself. However, in order to maintain the integrity of the cylinders themselves, the identification information can only be superficially inscribed and therefore has a tendency to become illegible. Also, the harsh environmental conditions to which the cylinders are subjected can cause oxidation of the cylinders, again tending to render the inscribed information illegible. This method of identifying gas cylinders also does not lend itself to automated reading of cylinder data.

Another method used to affix cylinder data to gas cylinders is to chemically bond an identification plate or label to the walls or neck of the gas cylinder container. A problem with this method resides with the fact that the material of which the plate or label is manufactured or stamped is usually of a material different from that of which the gas cylinder is made. Due to different thermal expansion characteristics of the two materials, a change in temperature will cause each of the two materials to expand or contract at a different rate, thereby weakening the chemical bonding between the materials and eventually resulting in a loss of adhesion.

Yet an additional technique for affixing cylinder data to gas cylinders is disclosed in U.S. Pat. No. 3,787,993. In the '993 patent, a gas cylinder is provided with two circumferential grooves located adjacent each other near the upper end of the cylinder. A color-coded elastic band having cylinder data on each side is stretched over the cylinder and then fitted into one of the grooves. Upon the occurrence of an event having relevance to the cylinder or its contents, the band can be stretched and turned over into the adjacent groove, thereby presenting a different color and different information for observance. Unfortunately, the band is not permanent in the sense that it can be repositioned and possibly removed. Further, because the band is elastic, it is possible for the band to be broken inadvertently if it is stretched too far. Also, the band can lose its elasticity or color after long periods in harsh environmental and handling conditions.

In order to facilitate inventory control and accountability of numerous pressurized gas cylinders, there remains a need to be able to permanently affix cylinder data which can be either manually or automatically interpreted and which is capable of long term association with the container being identified and which will maintain its integrity over long periods in harsh environmental and handling conditions.

SUMMARY OF THE INVENTION

The present invention overcomes the foregoing and other drawbacks of the prior art by providing an identification neck ring for a pressurized gas cylinder. The neck ring carries cylinder data which can be read either manually by an operator, or automatically by machine.

One feature of the present invention lies in the provision of an identification neck ring which allows cylinder data to be carried thereon in a permanent manner which can be either manually or automatically read. One or more encoded devices are carried on a base structure portion of the neck ring and can take many forms, including but not limited to a series of parallel bars which can be optically scanned and decoded. A cover structure protectively overlays the encoded devices.

Another feature of the invention lies in the provision of a cylinder identification neck ring which is rigidly and permanently affixed to a cylinder. A base structure portion of the neck ring threadedly engages the neck portion of the cylinder and is rigidly held in place by a plurality of locking pins.

Another feature of the invention lies in the provision of a cylinder identification neck ring which can be manufactured and installed quickly and inexpensively. As the cylinder identification neck ring is not integral with the gas cylinder, presently existing gas cylinders can be easily retro-fitted with the device. The formation of special grooves or other modifications to existing gas cylinders is not necessary.

In accordance with another form of the present invention, an identification neck ring for a cylinder includes a base structure having a radially extending collar which encircles the threaded neck portion of the cylinder, an outwardly facing skirt which extends downwardly from the collar and which encircles the threaded neck portion of the cylinder, and a plurality of fingers extending radially inwardly from the inner diameter of the collar. The collar and the skirt are adapted to receive inexpensive, stick-on labels displaying cylinder data. The fingers mechanically connect the base structure to the neck portion of the cylinder without using threads or special connectors.

In addition to providing a cylinder identification neck ring having many of the advantageous features of the previously described embodiment, the alternative embodiment can be manufactured and installed even more quickly and inexpensively. The alternative embodiment is especially preferred in those circumstances where the user has the capability of preparing inexpensive, stick-on labels, or in situations where there is no need or desire to provide a permanent attachment of the labels to the neck ring.

BRIEF DESCRIPTION OF THE DRAWINGS

The foregoing and other features of the present invention will be better understood by referring to the description and claims which follow, taken together with the accompanying drawings, wherein:

DESCRIPTION OF THE PREFERRED EMBODIMENT

Figure 1:
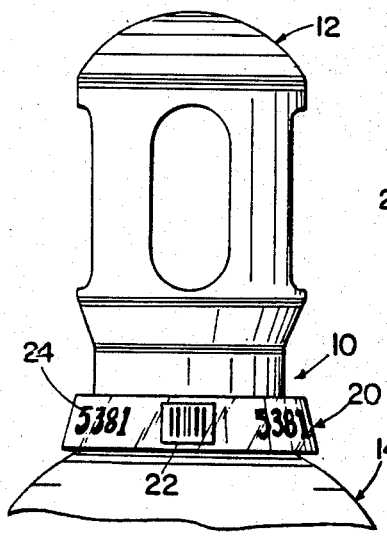
FIG. 1 is a side elevational view of an identification neck ring embodying the present invention shown installed on a pressurized gas cylinder.
Figure 2:
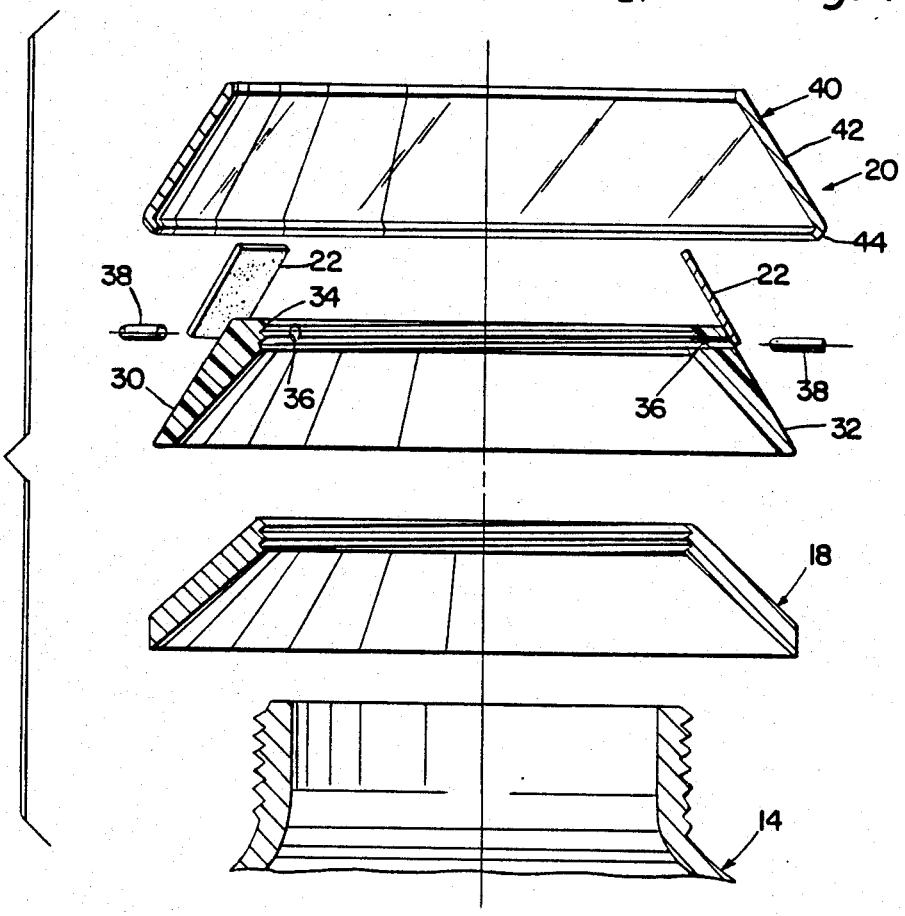
FIG. 2 is an exploded view, in cross-section, of the identification neck ring of FIG. 1 also showing the upper portion of the gas cylinder and a protective collar.

Referring to FIG. 1, a pressurized gas cylinder is indicated generally by the numeral 10. The cylinder 10 carries a cap 12 which protectively houses a valve (not shown) for controlling the flow of material into and out of the cylinder 10. The cylinder 10 has an elongate body 14 formed from steel and having a threaded neck 16 at its upper end as shown in FIG. 2. A protective collar 18 formed from steel threadedly engages and encircles the neck 16 of the cylinder 10 and protectively shrouds the upper portion of the elongate body 14.

Referring to FIGS. 1 through 4, an identification neck ring 20 is shown installed above the protective collar 18 on the cylinder 10. The identification neck ring 20 encircles the threaded neck 16 and is rigidly affixed thereto. The identification neck ring 20 includes encoded devices 22, identification labeling 24, a base 30, and a protective transparent cover 40.

Figure 3:
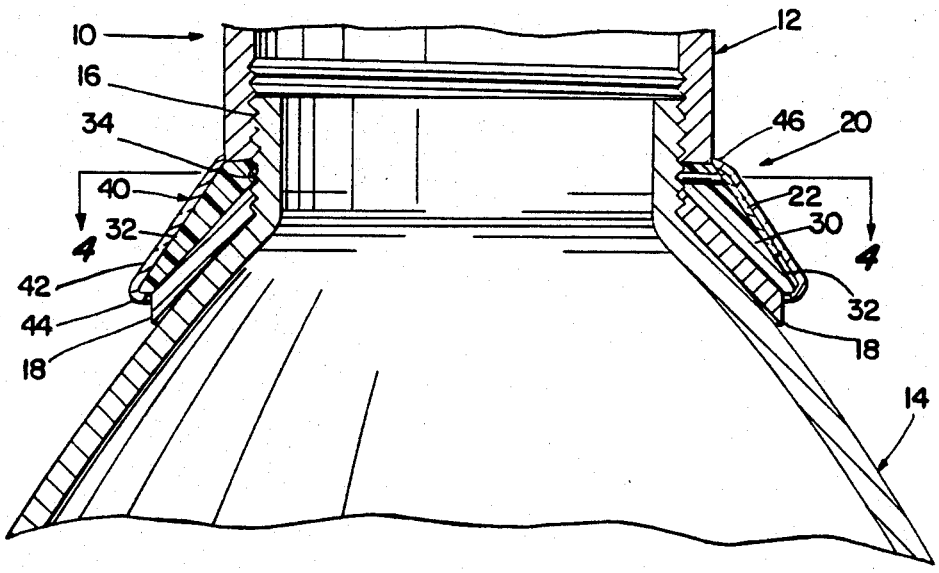
FIG. 3 is a sectional view as seen from the plane indicated by the broken line 3—3 in FIG. 4.

As is seen in FIGS. 2 and 3, the base 30 has a generally conical cross-section and preferably is formed from a plastics or die cast material using molding techniques. The base 30 includes an outwardly facing, downwardly extending surface 32 upon which the encoded devices 22 and the identification labeling 24 are affixed. The base 30 has an upper threaded portion 34 which threadedly engages the neck 16 of the cylinder 10. The base 30 includes a plurality of openings 36 extending through the upper threaded portion 34. In preferred practice the base 30 includes three openings 36 equally spaced 120 degrees apart from each other. Compression pins 38 are installed in the openings 36 by conventional press fitting techniques and serve to lock the base 30 in place when impacted.

To secure the base 30 to the cylinder 10, the threaded portion 34 is threaded onto the threaded neck 16 and is tightened down against the protective collar 18. Once the base 30 is snugly affixed to the neck 16, the compression pins 38 are impacted with a punch or the like thereby causing the heads of the pins 38 to impinge on the threaded surfaces of the neck 16. The heads of the pins 38 preferably are of the type that, when impacted, compress or flatten out in the threaded portion of the neck 16 so as to rigidly and permanently affix the base 30 to the cylinder 10. After installing the base 30, each of the openings 36 is filled with a plug (not shown) which is either chemically or ultrasonically bonded therein. Alternatively, the openings 36 can be filled with any one of a number of commercially available fillers.

Although in the preferred practice of the present invention the compression pins 38 rigidly affix the base 30 to the cylinder 10, it should be understood that the pins 38 might also take a variety of other forms such as set screws or the like. Where set screws are utilized, the openings 36 would be threaded and the set screws 38 would be mechanically tightened to securely affix the base 30 to the cylinder 10.

At least one encoded device 22 is affixed to the surface 32 of the base 30 by conventional chemical, mechanical or ultrasonic bonding techniques. In preferred practice, three encoded devices 22 containing identical cylinder data are employed and are affixed to the base 30. In this configuration, the encoded devices 22 are positioned at locations on the face 32 which are equally spaced around the cylinder 120° degrees apart. As the cylinders 10 are often ganged together on pallets and cannot easily be rotated for scanning, three encoded devices 22 are employed to facilitate machine decoding of the device 22 regardless of the angular orientation of the cylinder 10. Although in practice the use of three encoded devices 22 has been found to be optimal, it should be understood that fewer or more encoded devices 22 can be employed.

Figure 4:
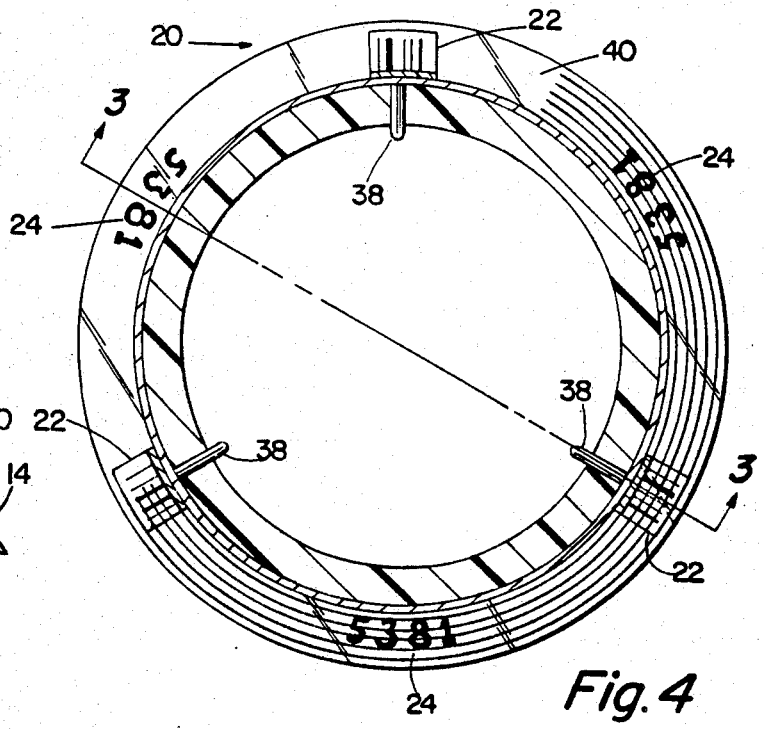
FIG. 4 is a sectional view as seen from a plane indicated by the line 4—4 in FIG. 3.

The encoded devices 22 can take any one of a number of commercially available forms. The type of device 22 employed depends on the amount of information to be stored and the scanning device which will be employed to decode the devices 22. Referring to FIGS. 1 and 4, the devices 22 display conventional bar coding such as that which is widely used in connection with the Uniform Product Code (UPC). This type of encoded device 22 takes the form of a paper thin material having a series of parallel bars of varying thickness and spacing and which is decoded by an optical scanner. An encoded device 22 similar to this configuration is desirable inasmuch as the device is thin and inexpensively manufactured and can be directly affixed to the surface 32 of the base 30 as shown. It should be noted, however, that encoded devices 22 shown in the accompanying Figures are merely for illustrative purposes and virtually any commercially available encoded device could be substituted. It might, however, be necessary to provide a recess in the surface 32 if the encoded device has a substantial thickness which would prevent the cover 40 from being installed as described herein.

In preferred practice, alpha numeric labeling 24 is also provided o the surface 32. The alpha numeric labeling is provided to facilitate manual reading of cylinder data which can either substitute for machine reading of the data or can serve as a manual check on the accuracy of machine decoding. The alpha numeric labeling contains the same cylinder data as is contained on the encoded devices 22 and would likewise be provided in triplicate and equally spaced around the neck 16 of the cylinder 10. Although the alpha numeric information is shown as being located midway between adjacent encoded devices 22, the alpha numeric information 24 could likewise be located above, below, or on the encoded devices 22, or at any other angular orientation. The alpha numeric information 24 can take any one of a number of commercially available forms, such as decals, stenciling or the like.

The protective cover 40 is formed from a transparent plastics material by conventional molding techniques. The cover 40 preferably is tinted to screen out ultraviolet light which tends to degrade the quality of some encoded devices 22, such as those which are optically decoded. The cover 40 includes a downwardly and outwardly extending circular sidewall 42 which overlays the surface 32 when installed. The cover 40 provides a protective shroud which encases the encoded devices 22 and alpha numeric information 24 thereby protecting them from harsh environmental and handling conditions. The cover 40 is provided with an annular lip 44 near its bottom edge which clamps over a bottom edge of the base 30 when installed. The cover 40 is formed from a resilient plastics material and is press fitted over the base 30 whereby the bottom edge 44 expands and snaps over the bottom edge of the base 30. The annular lip 44 serves to fasten the cover 40 to the base 30 as well as to impede the capilliary action of moisture, thereby sealing the bottom edge of the base 30 and cover 40 and protecting the encoded devices 22 and alpha-numeric information 24. A top edge 46 of the cover 40 abuts a portion of the base 30 and is affixed thereto by conventional chemical, mechanical or ultrasonic bonding techniques.

While the cover 40 has been described as utilizing an annular lip 44 to fasten the cover 40 to the base 30, other methods of connecting these structures might also be employed. For example, the cover 40 and base 30 might be provided with molded interlocking structures so that the base 30 and cover 40 snap together. Alternatively, the cover structure 40 might be fastened to the base 30 by any one of a wide variety of conventional chemical, mechanical or ultrasonic bonding techniques.

While the identification neck ring 20 is shown as being installed atop the protective metal collar 18, this is only for purposes of illustration as most conventional pressurized gas cylinders have a protective collar 18 installed thereon. The protective metal collar 18 could be completely replaced by the identification neck ring 20 in the case of new cylinders 10. In cases where the identification neck rings 20 completely replace the collars 18, a significant savings in the cost of manufacturing the cylinders 10 could be realized, as the metal collars 18 cost approximately five times more to manufacture than the identification neck rings 20. However, as most presently existing pressurized gas cylinders 10 are provided with protective metal collars 18, the identification neck rings 20 are shown as being installed atop the collars 18.

Figure 5:
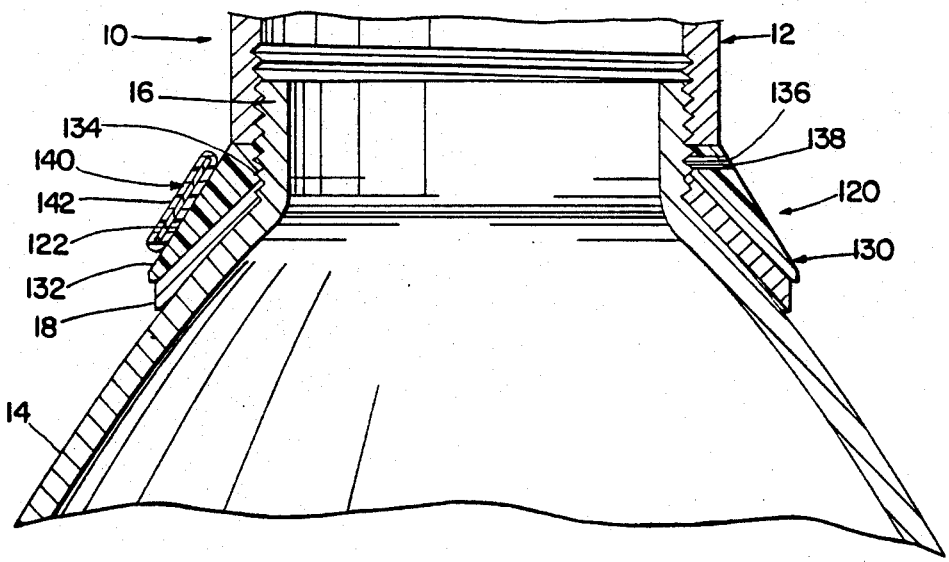
FIG. 5 is a sectional view similar to FIG. 3 showing a second embodiment of an identification neck ring incorporating features of the present invention wherein individually packaged encoded devices are affixed to the base structure.

Referring to FIG. 5, a second embodiment of an identification neck ring incorporating features of the present invention is indicated generally by the numeral 120. The neck ring 120 includes a base 130 and a plurality of individually packaged encoded devices 140. The neck ring 120 is configured to encircle the threaded neck portion 16 of the cylinder 10.

As is seen in FIG. 5, the base 130 has a generally conical cross section and preferably is formed from plastics or die cast material using molding techniques. The base 130 includes an outwardly facing, downwardly extending surface 132 upon which individual encoded device packets 140 and identification numbering (not shown) are affixed. The base 130 has an upper threaded portion 134 which engages the neck 16 of the cylinder 10. The base 130 includes a plurality of openings 136 extending through the threaded top portion 134 of the base 130. In preferred practice, three openings 136 extend through the base 130 and are spaced 120° degrees apart from each other. Compression pins 138 are installed in the openings 136 as previously described for the base 30.

The base 130 is installed on the cylinder 10 in a similar manner to that described previously for installing the base 30. To install the base 130 on the cylinder 10, the threaded portion 134 of the base 130 is engaged with the threaded neck 16 and the base 130 is tightened down against the protective collar 18. Once the base 130 is positioned on the neck 16, the compression pins 138 are impacted with a punch or the like thereby causing the heads of the pins 138 to impinge on the threaded surface of the neck 16. The heads of the pins 138 preferably are of a type that, when impacted, compress or flatten in the threaded portion of the neck 16 so as to rigidly and permanently affix the base 130 to the cylinder 10. After installing the base 130, each of the openings 136 is filled with a plug (not shown) which is either chemically or ultrasonically bonded therein. Alternatively, the openings 136 can be filled with any one of a number of commercially available fillers or bonding agents.

Although in the preferred practice of the present invention the compression type pins 138 rigidly affix the base 130 to the cylinder 10, it should be understood that the pins 138 might also take the form of set screws or the like. In such a configuration, the openings 136 would be threaded and the set screws 138 would be mechanically tightened to securely affix the base 130 to the cylinder 10.

At least one encoded device packet 140 is affixed to the surface 132. The encoded device packet 140 includes an encoded device 122 which is enclosed by a protective case 142 formed from a plastics material or the like. The encoded devices 122 are similar to the encoded devices 22 previously described. However, each of the encoded devices 122 is individually packaged in the case 142 and sealed therein. The case 142 could take any one of a number of commercially available forms. Where the encoded devices 122 are of the type which are optically scanned or decoded, the protective case 142 preferably is formed from a transparent plastics material.

In preferred practice, three encoded device packets 140 are affixed to the surface 132 by conventional chemical, mechanical or ultrasonic bonding techniques. As the base 130 and protective case 142 are both formed from plastics materials, the usual problems associated with bonding of dissimilar materials is overcome. The packets 140 are equally spaced from each other and contain identical cylinder data, as previously described for the neck ring 20.

Figure 6:
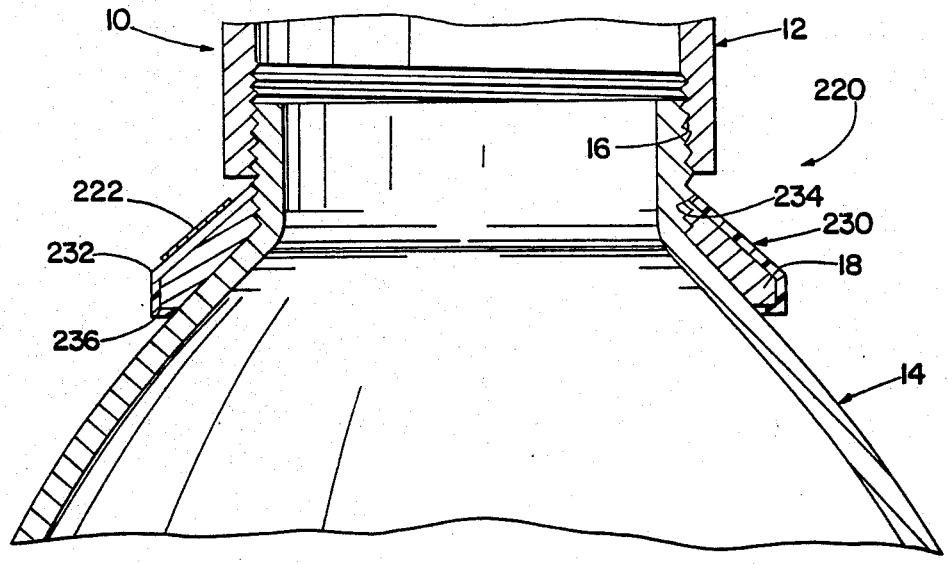
FIG. 6 is a sectional view similar to FIG. 3 of a third embodiment of an identification neck ring incorporating features of the present invention.
Figure 10:
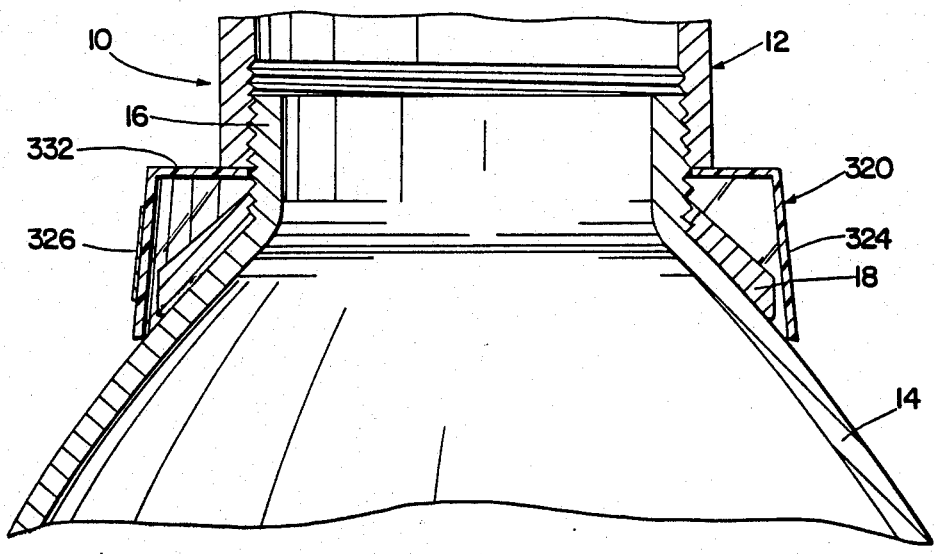
FIG. 10 is a sectional view similar to FIG. 3 showing the fourth embodiment of the identification neck ring of the present invention.

Referring to FIG. 6, a third embodiment of an identification neck ring incorporating features of the present invention is indicated generally by the numeral 220. The neck ring 220 includes a base 230 and encoded devices 222.

The neck ring 220 is configured to encircle the threaded neck portion 16 of the cylinder 10. As is seen in FIG. 6, the base 230 has a generally conical cross section and preferably is formed from plastics or die cast material using molding techniques. The base 230 includes an outwardly facing, downwardly extending surface 232 upon which the encoded devices 222 and identification labeling (not shown) are affixed. The base 230 has an upper threaded portion 234 which engages the threaded neck 16. Unlike the bases 30 and 130 previously described, the base 230 is provided with an annular lip 236 near its bottom edge which engages the bottom outer edge of the protective collar 18. The base 230 is formed from a resilient plastics material so that its bottom edge expands as the base 230 is tightened down against the protective collar 18. The base 230 becomes permanently installed on the cylinder 10 when the annular lip 236 snaps over the bottom edge of the protective collar 18 as the base 230 is threaded onto the neck portion 16 of the cylinder 10.

In preferred practice, three encoded devices 222 are affixed to the surface 232 by conventional chemical, mechanical or ultrasonic bonding techniques. The encoded devices 222 are substantially identical to the encoded devices 22, are equally spaced from each other, and contain identical cylinder data as described for the neck ring 20. However, protected encoded devices similar to the previously described encoded device packets 140 can also be used to replace the unprotected encoded devices 222 shown in FIG. 6. Likewise, the encoded devices 222 can be protected by a protective cover similar to the previously described cover 40.

Referring to FIGS. 7–10, a fourth embodiment of an identification neck ring incorporating features of the present invention is indicated generally by the numeral 320. The neck ring 320 defines a base structure having a generally flat, radially extending collar 322 which encircles the neck 16 of the cylinder 10. An outwardly facing skirt 324 extends downwardly from the collar 322 and encircles the cylinder 10. A plurality of encoded devices 326 substantially identical to the encoded devices 22 are affixed to the outer surface of the skirt 324.

Figure 7:
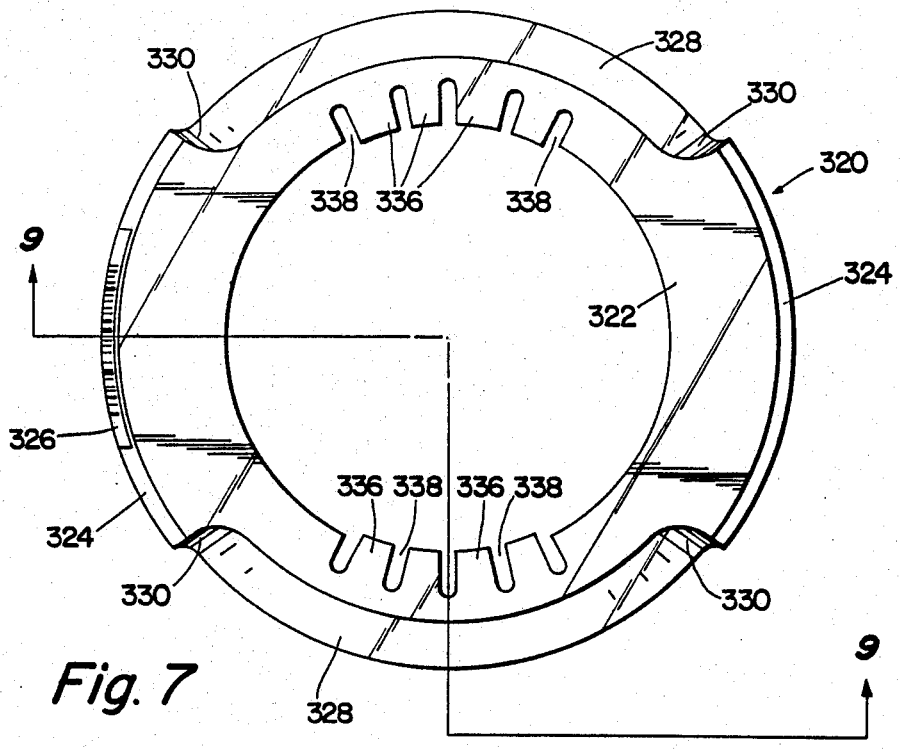
FIG. 7 is a plan view of a fourth embodiment of an identification neck ring incorporating features of the present invention.
Figure 8:
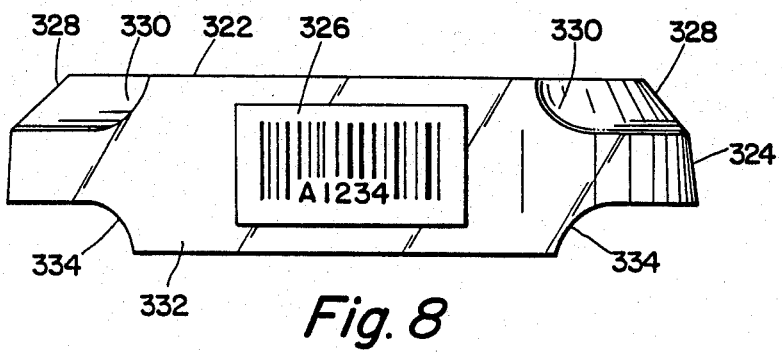
FIG. 8 is a side elevational view of the identification neck ring of FIG. 7.
Figure 9:
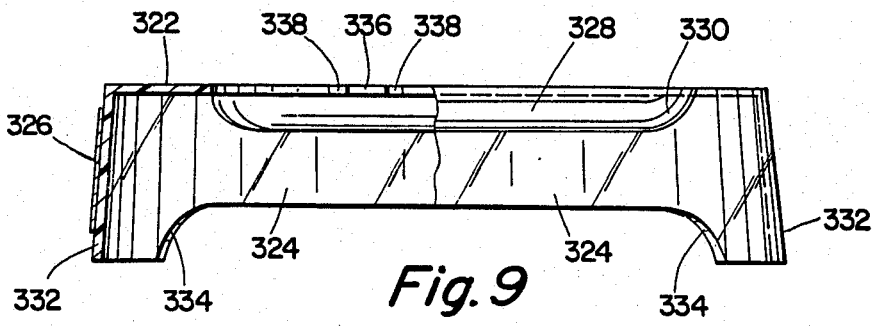
FIG. 9 is a partly sectional, side elevational view of the identification neck ring of FIG. 7 taken along a plane indicated by line 9—9 in FIG. 7.

Referring particularly to FIGS. 7–9, a pair of opposed, beveled shoulder portions 328 are provided at the intersection between the collar 322 and the skirt 324. The shoulder portions 328 do not completely encircle the collar 322, but extend for about 105° degrees about the periphery of the collar 322. The shoulder portions 328 include contoured end regions 330 which provide a smooth transition at the intersection of the collar 322, the skirt 324, and the shoulder portions 328. A pair of opposed, downwardly extending wall portions 332 are provided for the skirt 324 at those radial locations intermediate the shoulder portions 328. The wall portions 332 are connected to the bottom edge of the skirt 324 by means of contoured portions 334. The use of the wall portions 332 in conjunction with the skirt 324 provides a large enough area to receive the encoded devices 326. The wall portions 332 also provide room for finger grips beneath the skirt 324 to assist the user in removing the neck ring 320 from the cylinder 10. For cylinders 10 having a relatively flat shoulder near the neck portion 16, the wall portions 332 can be eliminated, leaving the bottom edge of the skirt 324 in contact with the shoulder of the cylinder 10.

Referring to FIG. 7, the collar 322 includes a plurality of radially inwardly extending fingers 336. The fingers 336 extend radially inwardly a slight distance beyond the inner diameter of the collar 322. The fingers 336 are somewhat flexible and have an inner diameter approximately that of the threads of the neck portion 16. The fingers 336 are defined and spaced by intervening cut-out sections 338. The cut-out sections 338 are spaced approximately 13 degrees from each other. In the embodiment illustrated, two opposed sets of fingers 336 are provided. Depending upon the size of the cylinder 10, the neck ring 320 will be larger or smaller as required. For large neck rings 320, four sets of fingers 336, each spaced 90 degrees from adjacent sets, could be used. Other possible configurations of the fingers 336 and the cut-out sections 338 will be apparent to those skilled in the art.

Depending upon the size of the neck ring 320 being used with the cylinder 10, the encoded devices 326 can be affixed to the upper surface of the collar 322 or to the skirt 324 (as illustrated). Additional identifying information can be included as part of the shoulder portions 328. Because it is expected that the neck rings 320 will be manufactured from a plastics material in a molding operation, it is a relatively easy matter to configure the die to mold additional identifying information directly into the surface of the neck ring 320.

In use, the neck ring 320 can be applied to, or removed from, a cylinder 10 simply by removing the cap 12 and moving the neck ring 320 relative to the neck portion 16. The fingers 338 will engage the threads of the neck portion 16 so as to tightly engage the neck portion 16 without requiring that a threaded connection be made. After the neck ring 320 has been moved to that position shown in FIG. 10, the cap 12 can be screwed into place. The cap 12 will engage the innermost portion of the fingers 338 and the collar 322, thereby clamping the neck ring 320 in place. If the neck ring 320 is manufactured of a transparent plastic material any identifying information carried by the previously placed collar 18 will be visible. For those instances where the encoded devices 326 are readily and inexpensively available, the neck ring 320 represents an exceedingly inexpensive and effective technique for providing an identification device for a container.

Although the invention has been described in its preferred form with a certain degree of particularity, it is to be understood that the present disclosure of the preferred form has been made only by way of example and that numerous changes in the details of construction and combination and arrangement of parts may be resorted to without departing from the spirit and scope of the invention as hereinafter claimed. The use herein of such terms as "inwardly," "downwardly," and other, similar terms describing the spatial relationship of various components to each other is intended for convenience only and no particular orientation of the invention or its components is to be implied from the use of such terms. It is intended that the patent shall cover, by suitable expression in the appended claims, whatever features of patentable novelty exist in the invention disclosed.

What is claimed is:

1. An identification device for a container, such as a gas cylinder, wherein the container includes a body having a threaded neck portion near one end, comprising:

(a) base means including a ring-like member formed from plastics material for encircling a threaded neck portion of a container on which the identification device is installed, with the base means having an integrally formed portion that defines an outwardly facing, downwardly extending surface which encircles the threaded neck portion of the container;

(b) connection means for mechanically connecting the base means to the threaded neck portion of the container so as to retain the identification device on the container once the identification device has been installed thereon with the ring-like member in encircling relationship with the threaded neck portion, with said connection means including a plurality of finger-like formation means that are formed integrally with the ring-like member and extend radially inwardly from the ring-like member for engaging the threaded neck portion of the container; and, (c) identification means affixed to the outwardly facing, downwardly extending surface of the base means for providing container data, with the identification means including a machine readable encoded device containing container data in a machine readable format to facilitate automatic reading thereof, and including an alpha-numeric presentation of said container data in a manually readable format to facilitate direct manual reading thereof.

2. The identification device of claim 1 wherein the identification means includes protective enclosure means for protectively encasing the encoded device.

3. The identification device of claim 1 wherein the identification means includes a plurality of said encoded devices to facilitate automatic reading thereof, and a plurality of said alpha-numeric presentations of container data to facilitate direct manual reading thereof.

4. An identification device for a container such as a gas cylinder wherein the cylinder includes a body having a threaded neck portion near one end, comprising:

(a) a base having an outwardly facing, downwardly extending surface which encircles the threaded neck portion of the cylinder;

(b) means for mechanically connecting the base to the neck portion of the cylinder;

(c) identification means affixed to the surface of the base for providing cylinder data, the identification means being in the form of an encoded device containing cylinder data in machine readable format to facilitate automatic reading; and, (d) the means for mechanically connecting the base to the neck portion of the cylinder including a plurality of fingers extending radially inwardly from the base.

5. An identification device for a container such as a gas cylinder wherein the cylinder includes a body having a threaded neck portion near one end, comprising:

(a) a base formed from a plastics material and having:

(i) a generally flat, radially extending collar which encircles the threaded neck portion of the cylinder;

(ii) an outwardly facing skirt which extends downwardly from the collar and which encircles the cylinder; and, (iii) a plurality of fingers extending radially inwardly from the inner diameter of the collar and which engage the threaded neck portion of the cylinder; and, (b) identification means affixed to the outer surface of the base for providing cylinder data, the identification means including a plurality of encoded devices which contain cylinder data in machine readable format to facilitate automatic decoding thereof, and alpha numeric information which presents cylinder data for manual reading.

6. The identification device of claim 5 wherein the identification means includes protective enclosure means for protectively encasing the encoded devices.

7. An identification device for installation on a container such as a gas cylinder, wherein the container has a hollow body for receiving and containing a product such as a compressed gas, with the body defining a neck formation, and with a portion of the neck formation having threads that extend circumferentially therearound, with the identification device being installable on the neck formation in surrounding relationship thereto, and wherein the identification device comprises:

(a) a base formed from a plastics material and having:

(i) generally flat, ring-like collar means for encircling the threaded neck portion of the container, with the ring-like collar means being a one piece structure that has integrally formed parts including a radially inward ring-like part and a radially outward ring-like part with each of said parts extending circumferentially about the threaded neck portion of the container when the identification device is installed on the container, but with the radially inward part of the ring-like collar means being located in closer proximity to the threaded neck portion of the container than is the radially outward part when the identification device is installed on the container;

(ii) outwardly facing skirt means formed integrally with the ring-like collar means and being connected to the radially outward ring-like part so as to extend downwardly therefrom for encircling portions of the neck formation of the container that are in close proximity to the threaded neck portion of the container, and with the skirt means defining radially outwardly facing surface means that is within plain view when the identification means device installed on the neck formation of the container; and, (iii) finger means including a plurality of finger portions that are formed integrally with the ring-like collar means and being connected to the radially inward ring-like part so as to extend radially inwardly therefrom for engaging the threaded neck portion of the container; and, (b) identification means carried by the outwardly facing surface means for providing container data, with the identification means including at least one encoded device which includes container data both in machine readable format to facilitate automatic decoding thereof, and in alpha numeric format for manual reading thereof.

8. The identification device of claim 7 wherein the identification means includes protective enclosure means for protectively encasing the encoded device.

9. The identification device of claim 7 wherein the identification means includes a plurality of said encoded devices.

10. An identification device for a container such as a gas cylinder wherein the container includes a body having a threaded neck portion near one end, comprising:

(a) a base formed from a plastics material and having:

(i) a generally flat, ring-like, radially extending collar which encircles the threaded neck portion of the container, with the collar having an inner diameter and an outer diameter, with the inner diameter being located more closely in proximity to the encircled threaded neck portion of the container than is the outer diameter;

(ii) an outwardly facing skirt which is formed integrally with the collar, which extends downwardly from the vicinity of the outer diameter of the collar, and which encircles portions of the container that are located near the threaded neck portion of the container; and, (iii) a plurality of fingers which are formed integrally with the collar, which extend radially inwardly from the inner diameter of the collar, and which engage the threaded neck portion of the container; and, (b) identification means affixed to the outer surface of the base for providing container data, the identification means including at least one encoded device which contains container data both in a machine readable format to facilitate machine reading thereof, and in an alpha numeric format to permit direct manual reading thereof.

11. The identification device of claim 10 wherein the identification means includes protective enclosure means for protectively encasing the encoded device.

12. The identification device of claim 10 wherein the identification means includes a plurality of said encoded devices.

13. An identification device for a container such as a gas cylinder wherein the cylinder includes a body having a threaded neck portion near one end, comprising:

(a) a base having an outwardly facing, downwardly extending surface which encircles the threaded neck portion of the cylinder;

(b) means for mechanically connecting the base to the neck portion of the cylinder;

(c) identification means affixed to the surface of the base for providing cylinder data, the identification means being in the form of an encoded device containing cylinder data in machine readable format to facilitate automatic reading; and, (d) the base including a generally flat, radially extending collar, a skirt extending downwardly from the collar, and a plurality of fingers extending radially inwardly from the collar.

* * * * *